US005635081A

United States Patent [19]

Yoshihara

[11] Patent Number: 5,635,081

[45] Date of Patent: Jun. 3, 1997

[54] FABRICATION METHOD OF FIELD-EMISSION COLD CATHODE

[75] Inventor: Takuya Yoshihara, Tokyo, Japan

[73] Assignee: NEC Corporation, Japan

[21] Appl. No.: 500,525

[22] Filed: Jul. 11, 1995

[30] Foreign Application Priority Data

Jul. 12, 1994 [JP] Japan ..... 6-182802

[51] Int. Cl.[6] ..... B44C 1/22

[52] U.S. Cl. ..... 216/11; 216/41; 216/67; 216/75; 216/76

[58] Field of Search ..... 216/2, 11, 24, 216/25, 38, 41, 67, 75, 76; 156/643.1, 656.1, 659.11; 437/228 TI; 445/25; 313/309, 336

[56] References Cited

U.S. PATENT DOCUMENTS

| | | | |
|---|---|---|---|
| 4,943,343 | 7/1990 | Bardai et al. | 216/11 X |
| 5,228,877 | 7/1993 | Allaway et al. | 216/11 X |
| 5,399,238 | 3/1995 | Kumar | 216/11 |

OTHER PUBLICATIONS

C.A. Spindt, C.E. Holland, A. Rosengreen and Ivor Brodie—Title: Field–Emitter Array for Vacuum Microelectronics—Document: IEEE Transactions on Electron Device, pp. 2355–2363, vol. 38, No. 10, Oct. 1991.

M. Urayama, Y. Maruo, Y. Akagi, T. Ise—Title: Fabrication of Cone–Like Field Emitters—Document: Digest of 53rd Science Lecture Meeting of Applied Physics, 19A–ZM–6, p. 553, Sep. 22, 1992, Published by: The Applied Physics Society in Japan.

*Primary Examiner*—William Powell

*Attorney, Agent, or Firm*—Ostrolenk, Faber, Gerb & Soffen, LLP

[57] ABSTRACT

In a fabrication method of a field-emission cold cathode, a conductive material for an emitter is first deposited on a Si substrate and then dry etched to form a conical emitter. An insulating layer and a gate electrode are deposited in such a manner as to cover over the emitters, and the surfaces of the emitters are flattened with a resist. Then, the insulating layer and the gate electrode are opened by etching back to expose the end of the conical emitter. Ta can be used as the conductive material to be deposited on the Si substrate. Meanwhile, the insulating layer to be deposited on the emitter can be formed by anodic oxidation. Further, where the height of the surface of the gate electrode from the surface of the Si substrate is set equal to the height of the emitter, detection of the end point at the later etching back step is facilitated.

7 Claims, 3 Drawing Sheets

FABRICATION METHOD OF FIELD-EMISSION COLD CATHODE

BACKGROUND OF THE INVENTION

1. Field of the Invention

This invention relates to improvements in or relating to a fabrication method of a field-emission cold cathode for a miniature vacuum field-effect device, that is, a vacuum microelectronic device.

2. Description of the Related Art

Conventionally, various proposals have been made for a structure and a fabrication method of a field-emission cold cathode for a vacuum microelectronic device.

For example, a field-emission cold cathode of the Spindt type disclosed by C. A. Spindt has such a structure as shown in FIG. 1 wherein a plurality of holes are perforated through an insulating layer 32 and a gate electrode 33 deposited on a silicon base 31, and a conical field-emission cathode 34 coated with a film of molybdenum (Mo) formed by vapor deposition is accommodated in each of the holes (IEEE Transaction on Electron Devices, pp. 2,355–2,363, Vol. 38, No. 10, 1991).

The Spindt type cold cathode of FIG. 1 is formed by the following procedure.

First, an oxide film of silicon dioxide (SiO2) is deposited into a thickness of approximately 1 μm on a silicon (Si) substrate 31 of a high specific conductance to form an insulating layer 32, and Mo which is for making gate electrode 33 is deposited into a thickness of 0.25 μm on the insulating layer 32. Then, a pattern of holes of the diameter of approximately 1 μm is formed in an array on the gate electrode 33 by EB exposure (electron-beam exposure). Thereafter, the oxide film of the insulating layer 32 and the Mo film of the gate electrode 33 are etched using this pattern. Further, a sacrifice layer of aluminum (A1) is vapor deposited obliquely on the gate electrode, and Mo is vapor deposited in the holes to form cone-line metal tips of Mo. Finally, the sacrifice layer of Al is removed by etching to form a cold cathode.

Meanwhile, a cold cathode of another structure shown in FIG. 2, which has been published by Urayama et al., may be fabricated by another method wherein the surface of a Si substrate 41 is worked into a trapezoidal shape by isotropic etching and then the Si substrate 41 is thermally oxidized to form a cold cathode cone, whereafter an insulating layer 42 and a gate electrode 43 are successively deposited on the cold cathode cone. In particular, a cap of a circular pattern of $SiO_2$ of approximately 2 μm is formed as a wet etching mask for Si on a Si substrate 41. Then, the Si substrate 41 is etched into a cone using an alkali etchant of KOH. Thereafter, the surface of the Si substrate 41 is thermally oxidized using an oxidizing furnace while the cap is left on the Si substrate 41 to form an insulating layer 42 of $SiO_2$ of the thickness of approximately 0.3 μm. Further, a gate electrode 43 of Mo is obliquely vapor deposited into the thickness of approximately 0.3 μm using an EB vapor depositing apparatus. Finally, the $SiO_2$ film is etched using buffered hydrofluoric acid to produce an electron emitting point of an emitter (M. Urayama, Y. Maruo, Y. Akagi and T. Ise, Fabrication of Cone-like Field Emitters, A Collection of Lecture Drafts for the 53rd Science Lecture Meeting of Applied Physics, 19a-ZM-6, pp.553, The Society of Applied Physics of Japan, Sep. 22, 1992).

The fabrication methods of a Spindt type cold cathode described above are so restricted in conditions for production of a film such as the film formation temperature or the directivity of vapor deposited particles with respect to a substrate that it is difficult to obtain cones of crystal of good quality because an emitter of Mo is formed by vapor deposition by a lift-off method after an insulating layer and a gate electrode are formed. Further, since an Al layer which is a layer to be peeled off is formed by oblique vapor deposition, even if a substrate is rotated and revolved, the vapor deposition condition of Al varies within the substrate, and consequently, a plurality of emitters formed in a plane will exhibit non-uniform shapes. Further, since an end of a cone is formed at the last stage in both of the fabrication methods, they have a problem in that it is difficult to improve the quality of the material of the cone and coat the cone with a different material.

SUMMARY OF THE INVENTION

The fabrication method of a field-emission cold cathode according to the present invention has been invented in order to eliminate the problems described above.

According to the present invention, there is provided a fabrication method of a field-emission cold cathode, which comprises the steps of depositing a layer of a first conductive material on a semiconductor substrate, etching the deposited layer of the first conductive material to form a tapering emitter, alternately depositing an insulating film and a layer of a second conductive layer on the semiconductor substrate in such a manner as to cover over the emitter, and opening the insulating film and the layer of the second conductive material on the emitter by etching back to expose the end of the emitter, the opened layer of the second conductive material serving as a gate electrode. Tantalum may be employed as the first conductive material to be deposited on the semiconductor substrate.

Preferably, the insulating film on the emitter is formed by a plasma oxidation system.

Preferably, the height of the surface of the gate electrode from the surface of the semiconductor substrate is equal to the height of the emitter.

According to the present invention, a cone which makes an emitter is formed first, and then an insulating layer and a gate electrode are deposited, whereafter an end of the cone is finally exposed. Consequently, a cone material of good quality can be used to form a film on the end of the cone. Further, since the diameter of the opening of the gate electrode depends upon the thickness of the insulating film, opening diameters which are high in reproducibility and uniformity can be obtained, and besides, reduced opening diameters can be obtained readily.

The above and other objects, features, and advantages of the present invention will become apparent from the following description referring to the accompanying drawings which illustrate examples of the preferred embodiments of the present invention.

DETAILED DESCRIPTION OF THE PREFERRED EMBODIMENTS

Figure 1:
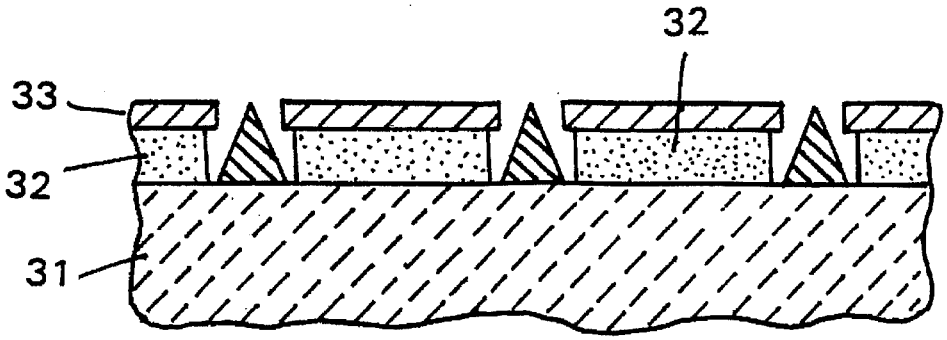
Fig.1 PRIOR ART
FIG. 1 is a schematic view showing the construction of a cold cathode of the Spindt type according to the prior art.
Figure 2:
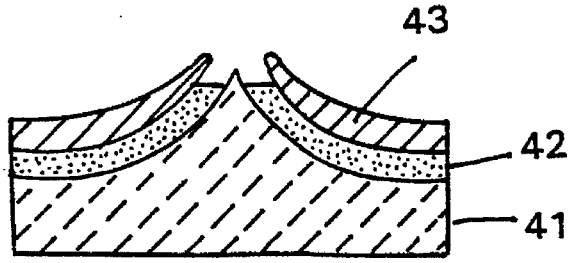
Fig.2 PRIOR ART
FIG. 2 is a schematic view showing the construction of an example of a silicon cold cathode according to the prior art.

In the first embodiment shown in FIG. 3:

(*a*) A Ta film 1 of a first conductive material is first deposited into a thickness of 0.5 μm on a Si substrate 11 by sputtering, and resist patterns 12 are formed on the Ta film 1. If the heating temperature of the Si substrate upon deposition of the Ta film 1 is set to 270° C. and the pressure of xenon (Xe) of the sputtering gas is set to 0.45 Pa, then a Ta film of a precise structure having a low internal pressure is formed.

(*b*) Then, isotropic etching is performed for the Ta film 1 by reactive ion etching (RIE) using $SF_6$ gas as an etchant to form emitters 2 of a substantially conical shape.

(*c*) Thereafter, the resist 12 which remains after step (*b*) is removed by ashing, and then, an oxide film 3 which serves as an insulating layer is deposited into a thickness of 0.2 μm on the Ta conical shapes, which make the emitters 2, by a LPCVD (low pressure chemical vapor deposition) method. In this instance, if the growth rate is high, then a cavity may be formed at end portions of the conical shapes, and therefore, the flow rate of the gas must be reduced to control the growth rate.

(*d*) After the insulating layer 3 is deposited, Ta of a second conductive material is deposited into a thickness of 0.2 to 0.3 μm as a gate electrode 4 on the insulating layer 3 by sputtering. Here, if the height of the surface of the gate electrode 4 from the surface of the Si substrate 11 is made equal to the height of the emitters, then the end points can be detected readily at a later etching back step.

(*e*) Then, resist 5 is spin applied to and flattened on the Ta layer 4 deposited on the oxide film 3 at step (*d*).

(*f*) Thereafter, the resist 5 is ion reactive etched using $SF_6$ gas as an etchant to perform etching back. In this instance, if the pressure of the etching gas is set to approximately 10.7 Pa (80 mtorr), the selection ratio between the resist 5 and the Ta film of the gate electrode 4 becomes lower while the selection ratio between the Ta film of the gate electrode 4 and the oxide film 3 becomes higher, and consequently, such a profile as seen in (*f*) of FIG. 3 can be obtained.

(*g*) Thereafter, the resist 5 is removed by ashing and the oxide film 3, which covers over end portions of the conical shaped emitters 2, is removed using buffered or dilute hydrofluoric acid. Consequently, a field-emission cold cathode as shown in FIG. 3 (*h*) of is obtained.

In the second embodiment shown in FIG. 4, (*a*) first, similarly as in the first embodiment, Ta is deposited into a thickness of 0.5 μm on a Si substrate 11 by sputtering, and a resist layer 12 is formed on the Ta film, then, (*b*) isotropic etching is performed. However, the time for the dry etching is shorter than that in the first embodiment so that the Ta film may be formed into trapezoids 6. Further, the etching is performed so that the Ta film may remain thin on a flat portion of the Si substrate 11 other than portions at which the Ta trapezoids 6 are formed. The Ta film is oxidized at a later step to form an insulating layer of Ta oxide.

(*c*) Thereafter, the resist 12 is removed by ashing, and the Ta film 6 of the trapezoidal shape is oxidized by anodic oxidation. Consequently, the formed Ta oxide is converted into an insulating layer 7, and conical shapes of Ta which comprise emitters 2 are formed in the inside of the insulating layer 7. (*d*) Then, Ta of a second conductive material is deposited into a thickness of 0.2 μm on the insulating layer 7 of Ta oxide by sputtering to produce a gate electrode 7.

The succeeding steps of (*e*) flattening by a resist 5, (*f*) etching back, (*g*) peeling off of the resist and (*f*) etching of the Ta oxide at end portions of the emitters are performed in a similar manner as in the first embodiment.

Figure 5:
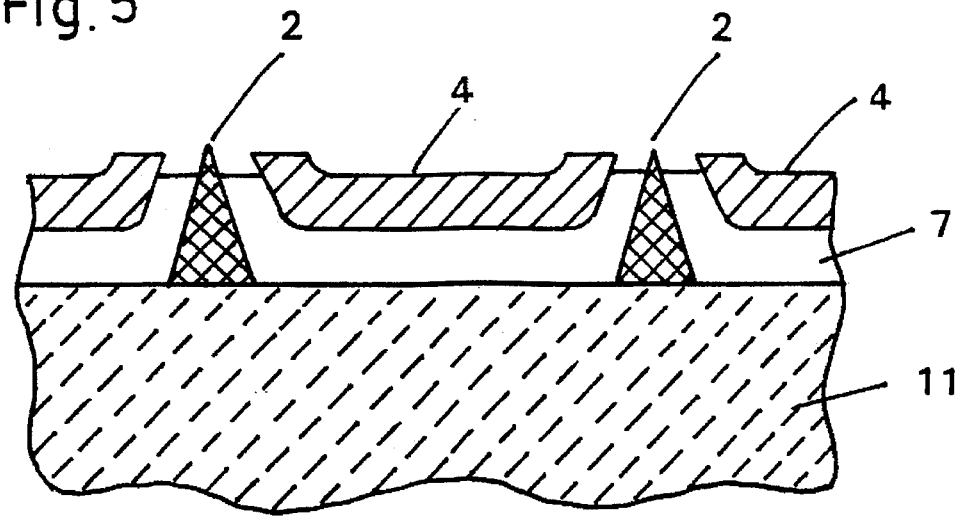
FIG. 5 is a schematic view showing the construction of an example of a cold cathode fabricated in accordance with the present invention.
Figure 3A:
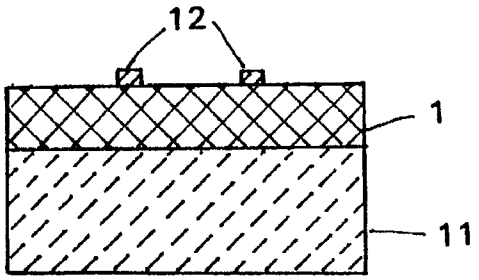
FIGS. 3(*a*)–(*h*) are a schematic views illustrating a fabrication process of a first embodiment of the present invention.
Figure 3B:
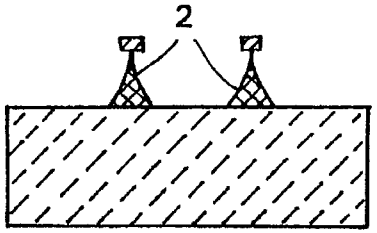
Figure 3C:
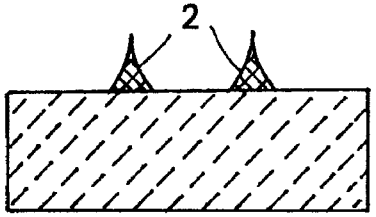
Figure 3D:
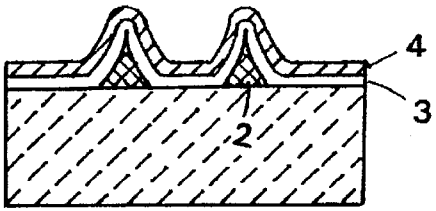
Figure 3E:
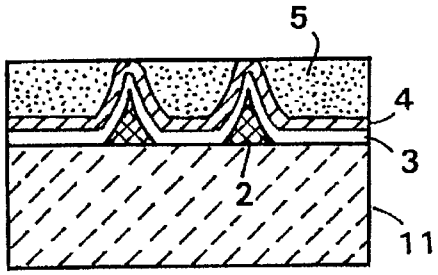
Figure 3F:
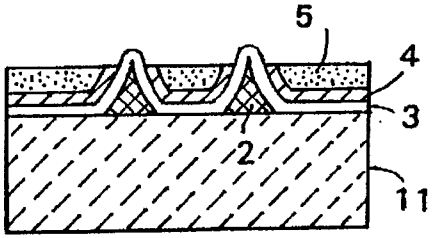
Figure 3G:
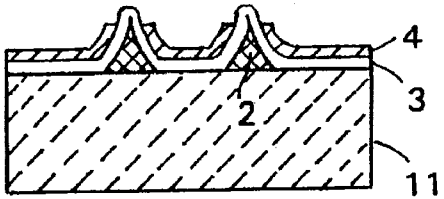
Figure 3H:
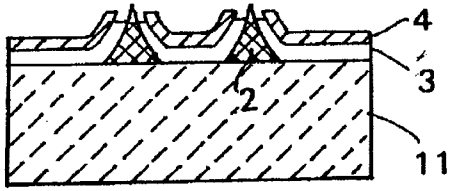
Figure 4A:
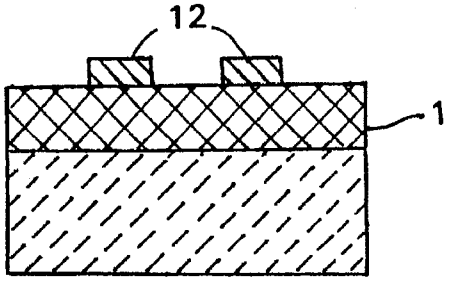
FIG 4(*a*)–(*h*) are a schematic views illustrating a fabrication process of a second embodiment of the present invention.
Figure 4B:
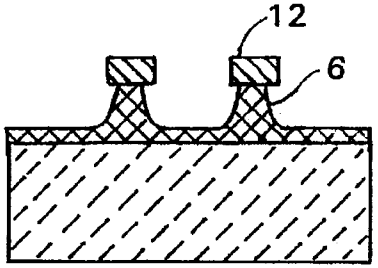
Figure 4C:
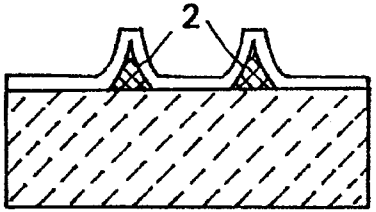
Figure 4D:
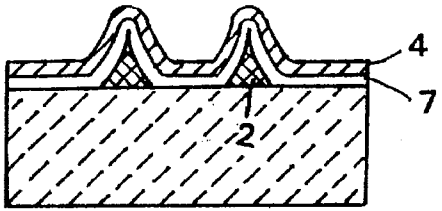
Figure 4E:
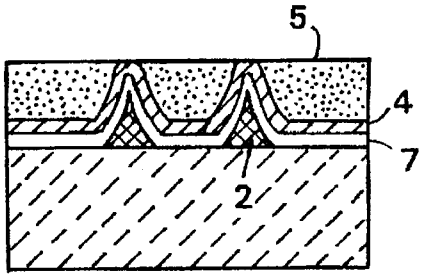
Figure 4F:
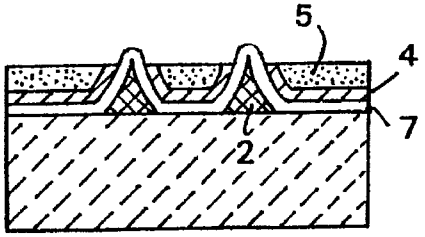
Figure 4G:
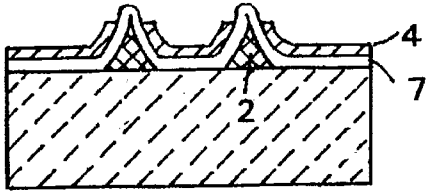
Figure 4H:
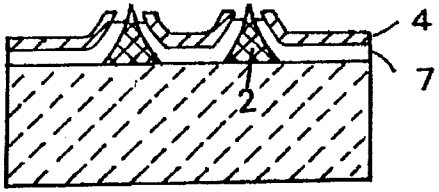

FIG. 5 shows an example of a field-emission cold cathode fabricated by the methods described above. Referring to FIG. 5, emitters 2 of Ta of a substanially conical shape with a height of 0.5 μm, and gate electrode 4 of Ta with a thickness of approximately 0.2 μm are provided on a Si substrate 11 with openings left through which ends of the emitters 2 are exposed.

As described above, according to the present invention, since Ta can be deposited using sputtering wherein the temperature of a substrate and the pressure of sputtering gas are optimized before an insulating layer and a gate electrode are deposited on the substantially conical shape, an emitter of fine structure having a smooth surface can be obtained. Further, since a coating can be provided on the substantially conical shape after the substantially conical shape it is formed, improvement in the coating and the material can be facilitated. Furthermore, since dry etching can be applied to formation of the substantially conical shape, a high degree of reproducibility and uniformity can be obtained for the.

It is to be understood that variations and modifications of the fabrication method of a field-emission cold cathode disclosed herein will be evident to those skilled in the art. It is intended that all such modifications and variations be included within the scope of the appended claims.

What is claimed is:

1. A fabrication method of a field-emission cold cathode, comprising the following steps: depositing a layer of a first conductive material on a semiconductor substrate, etching the deposited layer of the first conductive material to form a tapering emitter, alternately depositing an insulating film and a layer of a second conductive layer on the semiconductor substrate in such a manner as to cover over the emitter, and opening the insulating film and the layer of the second conductive material on the emitter by etching back to expose the end of the emitter, the opened layer of the second conductive material serving as a gate electrode.

2. A fabrication method of a field-emission cold cathode as claimed in claim 1, wherein the insulating film on the emitter is formed by a anodic oxidation system.

3. A fabrication method of a field-emission cold cathode as claimed in claim 1, wherein tantalum is employed as the first conductive material to be deposited on the semiconductor substrate.

4. A fabrication method of a field-emission cold cathode as claimed in claim 3, wherein the insulating film on the emitter is formed by a anodic oxidation system.

5. A fabrication method of a field-emission cold cathode as claimed in claim 1, wherein the first conductive material deposited on the semiconductor substrate is formed substantially conical in shape by dry etching.

6. A fabrication method of a field-emission cold cathode as claimed in claim 5, wherein an insulating layer of an oxide film is deposited on a tantalum film, which makes an emitter, by low pressure chemical vapor deposition.

7. A fabrication method of a field-emission cold cathode as claimed in claim 5, wherein the height of the surface of the gate electrode from the surface of the semiconductor substrate is equal to the height of the emitter.

* * * * *